US007581529B2

(12) United States Patent
Wolff et al.

(10) Patent No.: US 7,581,529 B2
(45) Date of Patent: Sep. 1, 2009

(54) FUEL INJECTOR

(75) Inventors: Guenter Wolff, Schwieberdingen (DE); Bernd Strauss, Breitenguessbach (DE); Hubert Stier, Vaihingen/Enz (DE); Helga Goller, Trunstadt (DE); Stefan Nuesslein, Litzendorf (DE); Reinhard Brendel, Stegaurach (DE)

(73) Assignee: Robert Bosch GmbH, Stuttgart (DE)

( * ) Notice: Subject to any disclaimer, the term of this patent is extended or adjusted under 35 U.S.C. 154(b) by 286 days.

(21) Appl. No.: 10/580,994

(22) PCT Filed: Nov. 3, 2004

(86) PCT No.: PCT/EP2004/052768

§ 371 (c)(1),
(2), (4) Date: May 26, 2006

(87) PCT Pub. No.: WO2005/052359

PCT Pub. Date: Jun. 9, 2005

(65) Prior Publication Data

US 2007/0131202 A1 Jun. 14, 2007

(30) Foreign Application Priority Data

Nov. 28, 2003 (DE) ..... 103 55 645

(51) Int. Cl.
*F02M 55/02* (2006.01)

(52) U.S. Cl. ..... 123/469; 123/456; 123/468

(58) Field of Classification Search ..... 123/469, 123/470, 468, 456, 447, 295, 430
See application file for complete search history.

(56) References Cited

U.S. PATENT DOCUMENTS 3,125,078 A 3/1964 Reiners
4,485,790 A * 12/1984 Nishimura et al. ..... 123/468

(Continued)

FOREIGN PATENT DOCUMENTS

AT 382 429 2/1987

(Continued)

*Primary Examiner*—Stephen K Cronin
*Assistant Examiner*—J. Page Hufty
(74) *Attorney, Agent, or Firm*—Kenyon & Kenyon LLP

(57) ABSTRACT

A sensor is used to sense a property relating to each one of a plurality of different elevational locations within a vertical plane that is normal to a length of an aircraft. The vertical plane passes through the doorway of the aircraft, and at least some of the plurality of different elevational locations are disposed outside a known surface boundary of the aircraft. A variation in the sensed property between two elevational locations is detected, the variation indicative of an elevational position of the known surface boundary. An elevational position of the doorway of the aircraft is determined based upon a known relationship between the known surface boundary and the doorway, and based upon the indicated elevational position of the known surface boundary. The determined elevational position of the doorway is used to guide an aircraft engaging portion of the movable bridge into elevational alignment with the said doorway.

11 Claims, 2 Drawing Sheets

U.S. PATENT DOCUMENTS

| | | | | |
|---|---|---|---|---|
| 5,687,696 | A * | 11/1997 | Takagi et al. | 123/516 |
| 6,234,135 | B1 * | 5/2001 | Lindblom | 123/193.5 |
| 6,807,946 | B2 * | 10/2004 | Koseki et al. | 123/470 |
| 6,810,546 | B1 * | 11/2004 | Smith | 123/294 |

FOREIGN PATENT DOCUMENTS

| | | |
|---|---|---|
| DE | 826 216 | 12/1951 |
| DE | 197 12 921 | 10/1998 |
| DE | 197 50 298 | 5/1999 |
| DE | 10260837 | 7/2003 |
| JP | 1-125860 | 5/1989 |
| WO | WO 98/16730 | 4/1998 |

* cited by examiner

FUEL INJECTOR

FIELD OF THE INVENTION

The present invention relates to a fuel injector.

BACKGROUND INFORMATION

German Patent Application No. DE 197 12 921 A1 describes a fuel-injection system which includes a cylinder head and at least one fuel injector having piezoelectric actuation. A fuel-supply line through which fuel flows into the individual fuel injector under relatively low pressure (3 to 4 bar) on the side, below the actuator, is provided in the cylinder head. Because of the actuator lifts and the action of a piston pump integrated in the fuel injector in the discharge-side region, the fuel is injected into the combustion chamber under a much higher pressure.

In particular when using this system in internal combustion engines having fuel injectors of a simpler construction and high-pressure injection without integrated pump, a disadvantage is that the fuel lines located outside the cylinder head will have been produced in a very complex manner and may be costly due to their unavoidable flexibility. The required space, the installation effort and the susceptibility to faults, especially with respect to external mechanical influences, is increased considerably.

SUMMARY

A fuel-injection system according to an example embodiment of the present invention may have the advantage that the required space, installation expense and the susceptibility to faults are considerably reduced. Moreover, the fuel-injection system may be very resistant to mechanical external influences. In addition, the number of detachable and fault-susceptible high-pressure connections may be markedly reduced.

In a preferred exemplary embodiment of the fuel-injection system according to the present invention the fuel connection of the fuel injector is arranged at the level of the valve needle. This allows for a very simple design of the fuel injector. In particular, it is possible to dispense with extensive sealing of the actuator chamber or the actuator and to use smaller dimensions for the fuel injector. This considerably reduces the installation space of the fuel injector in the cylinder head and improves the stability of the cylinder head.

The fuel lines may also be connected via at least the valve receiving openings and/or the fuel connections. In this way an especially simple interconnection of the fuel lines is possible.

In another preferred exemplary embodiment, the fuel connection has an outer first section and an inner second section, which is made up of at least one opening introduced into the side of the fuel injector. This may make it especially easy to adapt the fuel connection to the stability requirements in the region of the fuel connection and to the required flow characteristics that result, for instance, from the position in the fuel system.

The fuel lines may be interconnected via at least two openings in the second section, and/or the first section of the fuel connection extends in the form of an annular groove. Two fuel lines are, thus, able to be interconnected in a reliable and simple manner.

In addition, a fuel-line array formed by at least two fuel lines positioned one behind the other may supply fuel to at least two fuel injectors. The fuel lines are thus able to be positioned in the cylinder head in a simple and hydraulically advantageous manner.

In another preferred exemplary embodiment of the fuel-injection system according to the present invention, the fuel lines of a fuel line system are placed coaxially with respect to each other and/or are formed by a shared borehole. The fuel lines are thus able to be positioned in the cylinder head in an especially simple and hydraulically advantageous manner.

Due to the advantageous hydraulically parallel positioning of at least two fuel line arrays, it is possible to set up the fuel lines in the cylinder head in a simple and hydraulically advantageous manner even if a larger number of fuel line arrays is involved.

BRIEF DESCRIPTION OF THE DRAWINGS

An exemplary embodiment of the present invention is represented in simplified form in the figures and is explained in greater detail below.

DESCRIPTION OF EXAMPLE EMBODIMENTS

Figure 1:
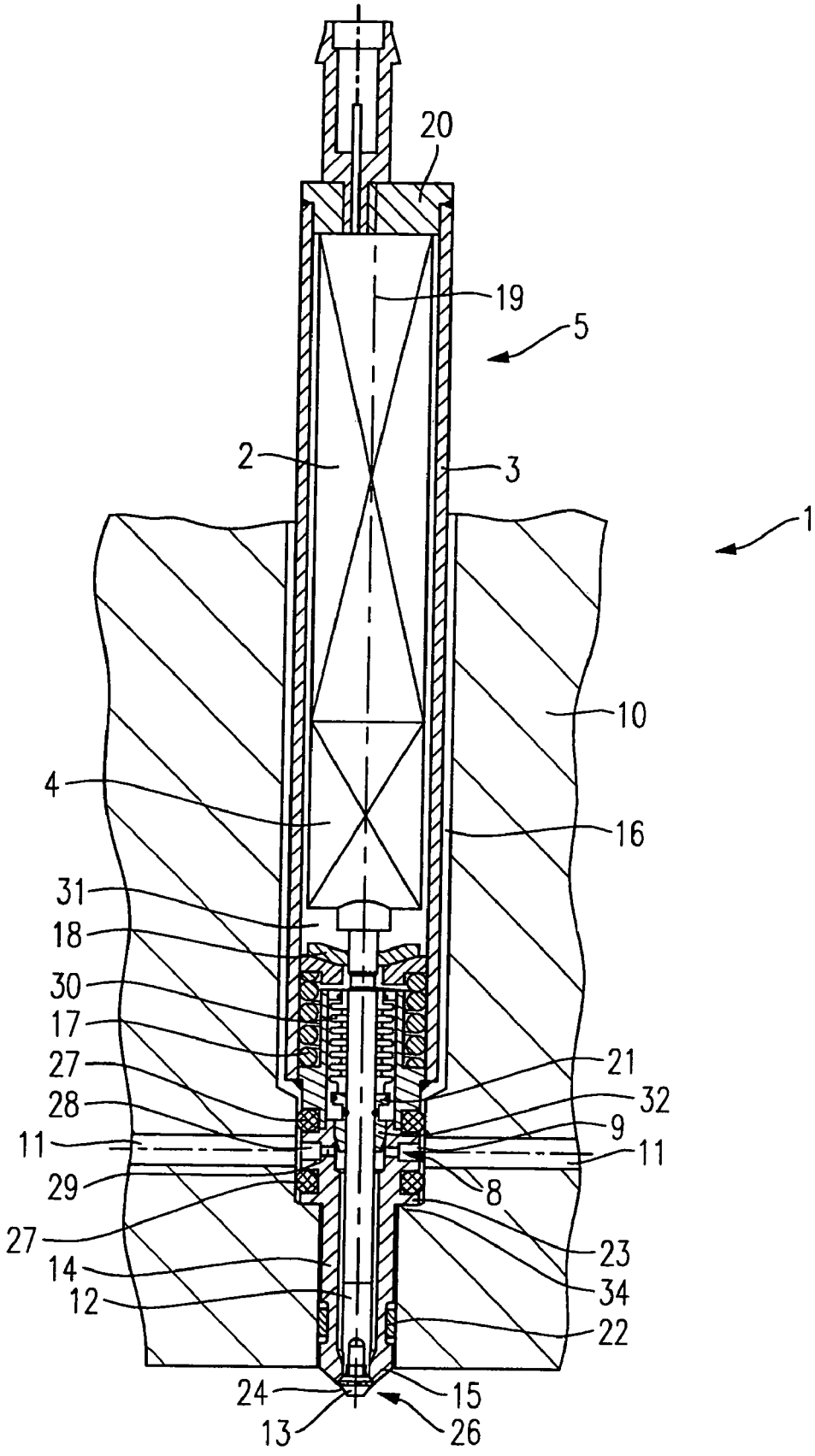
FIG. 1 shows a schematic sectional view of an exemplary embodiment of a fuel-injection system configured according to the present invention.

Fuel-injection system 1 shown in FIG. 1 is generally made up of a fuel injector 5 which is suitable as fuel injector 5 for fuel-injection systems of mixture-compressing internal combustion engines having external ignition for the direct injection of fuel into the combustion chamber of the internal combustion engine, and a cylinder head 10, which is shown only in part and has fuel lines 11 extending therein, which are interconnected inside cylinder head 10.

Fuel injector 5 engages with a cylindrical valve receiving opening 16, which is positioned in cylinder head 10, extends in the direction of the combustion chamber (not shown) and has a tapered design. In this exemplary embodiment, fuel injector 5 projects into the combustion chamber through valve-receiving opening 16 via its discharge-side end.

Fuel injector 5 is generally made up of a circular-cylindrical housing 3, which is sealed by a top 20 on the discharge-remote side, a nozzle body 14, an actuator 2 such as a piezoelectric actuator, and a valve needle 12 on which a valve-closure member 13 is formed on the discharge side.

Cylindrical nozzle body 14 partially engages with the discharge-side end of housing 3. In the exemplary embodiment, the profile of nozzle body 14 outside housing 3 tapers in the direction of the combustion chamber (not shown) via a step 23. Valve needle 12 is positioned coaxially in nozzle body 14 and in an axially moveable manner. It is guided via an annular guide element 32 which tightly surrounds valve needle 12 on the discharge side of a flange 21 and is located on the inner wall of nozzle body 14 in an immoveable manner.

Arranged on the discharge-side end of nozzle body 14 is a valve-seat body 15 integrally formed with nozzle body 14, valve-seat body 15 having a coaxially disposed discharge orifice 26 on the discharge side. Valve-closure member 13 cooperates with valve-seat surface 24 formed on valve seat member 15 to form a sealing seat. In the rest state, valve-closure member 13 of the outwardly opening fuel injector 5 is drawn into the sealing seat by a restoring spring 17 which is braced on nozzle body 14 and engages with valve needle 12 via a disk element 18 in the form of a perforated disk. The spring force of restoring spring 17 simultaneously retains the discharge-remote end of valve needle 12 in permanent contact with a coupler 4. This permanently clamps actuator 2 between coupler 4 and top 20.

An annular seal 22 between step 23 and the discharge-side end of nozzle body 14 seals nozzle body 14 from cylinder head 10. Nozzle body 14 rests in a hermetically sealing manner on a correspondingly formed shoulder 34 of valve-receiving opening 16 by way of step 23, for instance with the interposition of a seal which is not illustrated.

The discharge-side portion of nozzle body 15 projecting into the combustion chamber (not shown) tapers conically into the combustion chamber up to spray-discharge orifice 26 positioned coaxially in nozzle body 14, valve needle 12 having valve-closure member 13 reaching through spray-discharge orifice 26.

Fuel injector 5 has a center axis 19 with respect to which, in particular, actuator 2, restoring spring 17, hydraulic coupler 4 and valve needle 12 are coaxially arranged in this exemplary embodiment.

An actuator chamber 31 which is located in housing 3 and surrounds actuator 2 is sealed against the entry of fuel by convoluted bellows 30 which radially enclose valve needle 12.

Via its discharge-side end, convoluted bellows 30 is attached to valve needle 12 by way of flange 21; its discharge-remote end has been affixed in the region of the discharge-remote end of nozzle body 14, for instance in an integral manner.

In the exemplary embodiment shown, fuel connection 8 is radially positioned in nozzle body 14, between the discharge-side end of housing 3 and step 23. Fuel connection 8 lies on the same level as fuel lines 11, the two fuel lines 11 discharging into fuel connection 8. In the exemplary embodiment shown, fuel connection 8 is made up of a first section 28 and a second section 29. In the exemplary embodiment, first section 28, lying radially on the outside, has two cylindrical bores, which lie opposite one another and on the same axis as the two fuel lines 11, but first section 28 may also be embodied as a groove encircling nozzle body 14 radially.

Second section 29, which follows first section 28 on the inside, has a smaller flow cross section, and it has two cylindrical openings lying opposite each other and on the same axis as fuel lines 11.

A filter 9, which may be made of a tightly meshed material or a sieve-type laser-drilled material, for example, may be positioned upstream from fuel connection 8. Filter 9 is made of metal, for instance, and has the form of a circumferential ring, in particular in a first section 28 formed as annular groove. Filter 9 keeps harmful particles contained in the fuel away from fuel injector 5. The particles may be washed out of cylinder head 10 via a return line (not shown) connected to fuel lines 11.

Above and below fuel connection 8, circumferential annular sealing elements 27 are inserted in nozzle body 14 between step 23 and housing 3. Sealing elements 27 rest on the inner circumference of valve-receiving opening 16 in a hermetically sealing manner and prevent leakage of the fuel supplied via fuel line 11. In the exemplary embodiment shown, the portion of nozzle body 14 extending above step 23 does not abut the inner circumference of the valve-receiving opening. Instead, between the two sealing elements 27 nozzle body 14 has a smaller diameter than the inner diameter of valve-receiving opening 16 between both sealing elements 27. This makes it possible for the two fuel lines 11 shown to exchange fuel even without first section 28 having an annular groove design and/or only one opening being provided in second section 29 of fuel connection 8.

In response to excitation, actuator 2 expands, and, with the aid of hydraulic coupler 4, presses valve needle 12 in the discharge direction, counter to the spring force of restoring spring 17. Valve-closure member 13 lifts off from valve-seat surface 24, and the fuel supplied via fuel connections 8 and along valve needle 12 is spray-discharged into the combustion chamber (not shown) via spray-discharge orifice 26.

Figure 2:
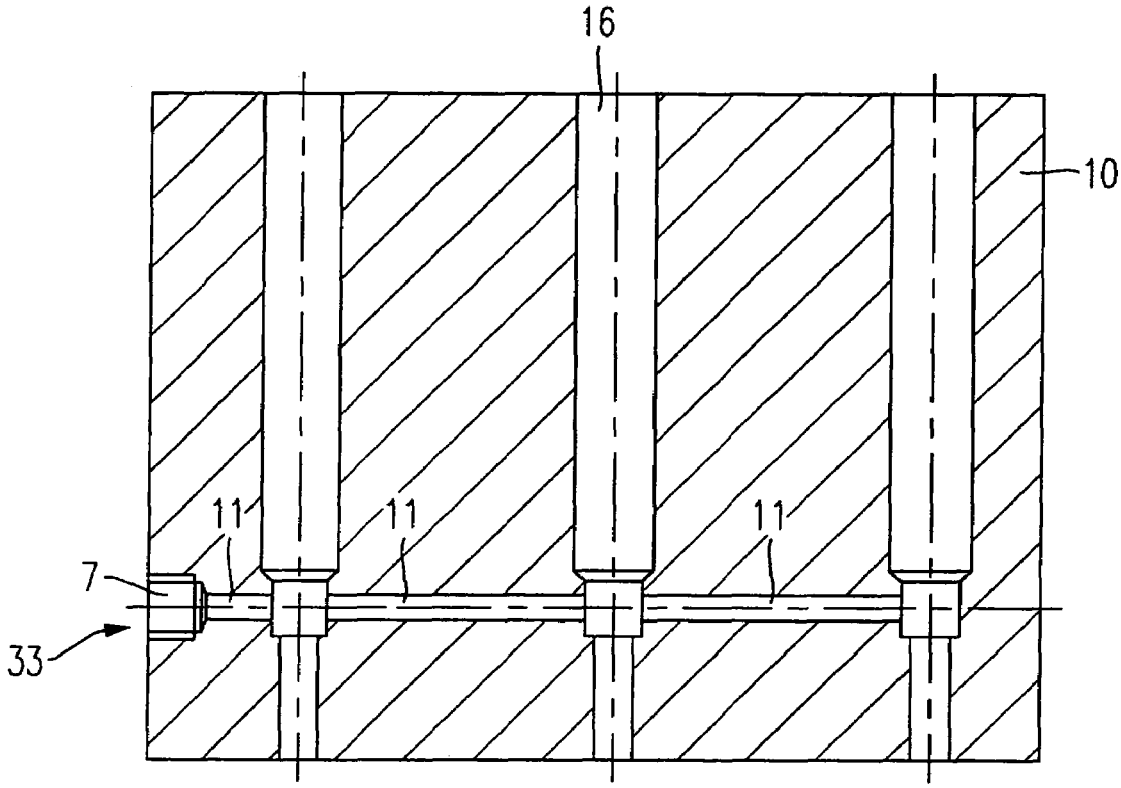
FIG. 2 shows a specific example embodiment of a cylinder head of a fuel-injection system configured according to the present invention.

FIG. 2 schematically shows a specific example embodiment of a cylinder head 10 of a fuel-injection system 1 according to the present invention. Illustrated cylinder head 10 is part of, for instance, a reciprocating combustion engine having three cylinders set up in series or a V6 cylinder engine having two cylinder heads 10. Cylinder head 10 has three valve-receiving openings 16 which correspond to the valve-receiving openings 16 indicated in FIG. 1. Cylinder head 10 has on its side a connection 7 designed as high-pressure connection, which is connected to a high-pressure pump (not shown) via a filter device (not shown), for instance.

In this way fuel is pressed into the three fuel lines 11, which in the exemplary embodiment are positioned one behind the other and coaxially relative to each other, for instance at 40 to 2000 bar and with the engine of the motor vehicle running. The three fuel lines 11 connected in series form a fuel-line array 33. In other exemplary embodiments a plurality of fuel-line arrays 33 may be positioned in a hydraulically parallel manner, for instance with the aid of a connection line (not shown) which likewise runs in cylinder head 10. Combinations of series and parallel arrangements are possible as well.

The features of the exemplary embodiment of the fuel-injection system and the specific embodiment of cylinder head 10 may be combined in any manner desired.

What is claimed is:

1. A fuel-injection system for the direct injection of fuel into a combustion chamber of an internal combustion engine, comprising:

a cylinder head in which fuel lines are positioned, the cylinder head having valve-receiving openings;

at least two fuel injectors situated in the valve-receiving openings, each of the fuel injectors having a fuel connection on a side thereof, the fuel connection having an outer first section and an inner second section;

wherein the fuel lines are connected via at least two openings of the second section coaxial with the fuel lines;

wherein the fuel lines discharge into the valve-receiving openings and into the fuel connection located on the side of each fuel injector, and wherein the fuel lines are interconnected in the cylinder head.

2. The fuel-injection system as recited in claim 1, wherein the fuel connection is situated on a level of a valve needle of each fuel injector.

3. The fuel-injection system as recited in claim 1, wherein the fuel lines are interconnected via at least the valve-receiving openings and the fuel connections.

4. The fuel-injection system as recited in claim 1, wherein the first section of the fuel connection has a form of an annular groove.

5. The fuel-injection system as recited in claim 1, wherein the fuel lines are connected via at least the first section of a fuel injector.

6. The fuel-injection system as recited in claim 1, wherein the fuel lines form at least one fuel-line array of at least two fuel lines hydraulically connected in series, the fuel-line array supplying fuel to at least two fuel injectors.

7. The fuel-injection system as recited in claim 1, wherein the fuel connection has a filter.

8. The fuel-injection system as recited in claim 7, wherein the filter is positioned around the first section in a form of a ring.

9. The fuel-injection system as recited in claim 7, wherein the filter is one of: i) made up of a meshed web, or ii) made up of an annular piece of metal which is perforated by laser-drilled holes.

10. The fuel-injection system as recited in claim 6, wherein the fuel lines of the fuel-line array at least one of: i) are positioned coaxially with respect to each other, and ii) exit through a shared borehole.

11. The fuel-injection system as recited in claim 6, wherein at least two fuel-line arrays are hydraulically positioned in parallel.

* * * * *

UNITED STATES PATENT AND TRADEMARK OFFICE

CERTIFICATE OF CORRECTION

PATENT NO. : 7,581,529 B2
APPLICATION NO. : 10/580994
DATED : September 1, 2009
INVENTOR(S) : Wolff et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 363 days.

Signed and Sealed this

Fourteenth Day of September, 2010

David J. Kappos

David J. Kappos
*Director of the United States Patent and Trademark Office*